US005828026A

United States Patent [19]

Brühl et al.

[11] Patent Number: 5,828,026

[45] Date of Patent: Oct. 27, 1998

[54] STOCK GIVING OFF ARC-EXTINGUISHING GAS, AND GAS-BLAST CIRCUIT BREAKER COMPRISING SUCH A STOCK

[75] Inventors: Bodo Brühl, Künten; Elias Jülke, Wettingen; Kurt Kaltenegger, Lengnau; Lutz Niemeyer, Birr; Leopold Ritzer, Untersiggenthal, all of Switzerland

[73] Assignee: ABB Research Ltd., Zurich, Switzerland

[21] Appl. No.: 623,959

[22] Filed: Mar. 29, 1996

[30] Foreign Application Priority Data

May 12, 1995 [DE] Germany ..... 195 17 540.9

[51] Int. Cl.[6] ..... H01H 33/02; H01H 33/04

[52] U.S. Cl. ..... 218/150; 218/85; 218/158; 218/64

[58] Field of Search ..... 218/18, 43, 63, 218/64, 65, 74, 85, 150, 158

[56] References Cited

U.S. PATENT DOCUMENTS

| | | | |
|---|---|---|---|
| 2,772,334 | 11/1956 | Latour | 218/150 |
| 3,192,347 | 6/1965 | Stringfellow et al. | 218/150 |
| 3,415,963 | 12/1968 | Stacy, Jr. et al. | 218/150 |
| 3,761,660 | 9/1973 | Jones | 200/144 C |
| 3,995,130 | 11/1976 | Mauhthe et al. | 200/148 G |
| 4,259,555 | 3/1981 | Kii | 200/148 R |
| 4,575,598 | 3/1986 | Yamagata et al. | 200/144 C |
| 4,617,542 | 10/1986 | Lutz et al. | 335/196 |
| 4,898,633 | 2/1990 | Doree et al. | 156/145 |
| 5,326,947 | 7/1994 | Edds et al. | 200/144 R |
| 5,509,558 | 4/1996 | Imai et al. | 218/143 |

FOREIGN PATENT DOCUMENTS

| | | |
|---|---|---|
| 1105947 | 5/1961 | Germany . |
| 1540104 | 12/1969 | Germany . |
| 1465621 | 6/1970 | Germany . |
| 2137150 | 2/1972 | Germany . |
| 2324125 | 11/1974 | Germany . |
| 2708030 | 10/1977 | Germany . |
| 2319932C2 | 7/1982 | Germany . |
| 3347893C2 | 9/1985 | Germany . |
| 9217024 U | 3/1993 | Germany . |

*Primary Examiner*—Cassandra C. Spyrou
*Assistant Examiner*—Michael J. Hayer
*Attorney, Agent, or Firm*—Burns, Doane, Swecker & Mathis, L.L.P.

[57] ABSTRACT

The stock contains an insulating-material matrix and a filler embedded in the matrix and is distinguished by a cellular structure. The predominant portion of the cells is filled with a material having arc-extinguishing properties or contains a material which, on exposure to an arc, forms arc-extinguishing gas. For the purpose of improving the making and breaking capacity, such a stock can advantageously be employed in a gas-blast circuit breaker in which arc-extinguishing gas is blown onto the switching arc. This involves the stock preferably being positioned at such points guiding the arc-extinguishing gas, at which the stock is exposed to the radiation of the arc and the thermal action of arc gases.

17 Claims, 3 Drawing Sheets

STOCK GIVING OFF ARC-EXTINGUISHING GAS, AND GAS-BLAST CIRCUIT BREAKER COMPRISING SUCH A STOCK

BACKGROUND OF THE INVENTION

1. Field of the Invention

The invention is based on an electrically insulating stock, which gives off arc-extinguishing gas when exposed to an arc and is based on an insulating-material matrix and a filler embedded in the matrix. At the same time, the invention also relates to a gas-blast circuit breaker which blows arc-extinguishing gas onto its switching arc and in which such a stock is employed in dielectrically and thermally highly stressed regions.

In high- and medium-voltage power switchgear involving extinguishing gas being blown onto the switching arc, it is normal practice to employ, in dielectrically and thermally highly stressed zones, stocks on the basis of polytetrafluoroethylene (PTFE). These stocks erode when exposed to the switching arc and in the process give off gas, preferably based on fluorine, which promotes extinction of the switching arc. Adding a pulverulent, for example ceramic, filler to the PTFE increases the burn-off resistance and thus reduces the formation of extinguishing gas.

Components based on such materials are usually fabricated by sintering compacts comprising PTFE powder and optionally provided filler powder at temperatures typically between 340° and 350° C., followed by the sintered bodies being cooled according to a specially adapted program, in which the crystallinity of the PTFE and accordingly the dimensional stability and dimensional accuracy of the components are retained.

2. Discussion of Background

DE 23 19 932 C2 describes a gas-blast circuit breaker wherein the switching arc between two consumable contacts burns inside an insulating-material nozzle based on PTFE. Under the influence of the heat and radiation of the arc, the PTFE is decomposed thermally and as a result the cross section of the constriction of the insulating-material nozzle is enlarged. Gaseous fluorine compounds produced in the course of thermal decomposition blow through the nozzle onto the switching arc and thus promote the extinction thereof quite significantly. Owing to the marked increase in the cross section of the nozzle constriction, the breaking capacity of the circuit breaker is considerably reduced after a few severe short circuits have been broken, and the nozzle then has to be replaced.

DE 27 08 030 A1 describes an insulating nozzle for a gas-blast circuit breaker, the insulating nozzle comprising a stock on the basis of an electrically insulating plastic which gives off arc-extinguishing gas when exposed to an arc, an example for such a plastic being PTFE, and, embedded in the plastic, a pulverulent filler such as, for example, graphite, carbon black, titanium dioxide, calcium fluoride or an aluminum dioxide such as, in particular, corundum.

With this insulating-material nozzle, the filler largely absorbs the electromagnetic radiation which is emitted by the switching arc and which comprises the visible spectrum and large regions of the infrared and ultraviolet range. Consequently, any penetration of the radiation into the interior of the insulating-material nozzle is largely prevented. Such a nozzle therefore is distinguished by low burn-off. At the same time, however, such a nozzle can only liberate a relatively small proportion of arc-extinguishing gases and vapors.

SUMMARY OF THE INVENTION

Accordingly, one object of the invention as set forth in patent claims 1 and 16 is to provide stocks of the type stated at the outset, which above a threshold value of the energy given off by an arc, primarily by radiation and formation of hot gas, provides a defined amount of arc-extinguishing gas, and at the same time to specify a gas-blast circuit breaker which is provided with such a stock and which is distinguished, with respect to a circuit breaker of comparable dimensions according to the prior art, by a higher breaking capacity.

The stock according to the invention shows non-linear burn-off behavior. If in the case of this stock the power given off by the arc via radiation or formation of hot gas is relatively small, burn-off remains small and accordingly virtually no arc-extinguishing gas is liberated from the cells. If, on the other hand, the power given off by the arc is large, for example in the case of a severe short-circuit current being switched, the cells are destroyed layer by layer, starting from the surface exposed to the arc, and thus, depending on the intensity and duration of the arc, additional arc-extinguishing gas is activated selectively in more than proportional amounts. Since the arc-extinguishing gas emanating from the cells serves not only for particularly effective extinction of the arc but at the same time also cools the surface of the stock exposed to the action of the arc, even in the case of powerful arcs, burn-off of the stock is kept relatively low and stopped, as soon as the power of the arc has dropped below a threshold value.

Said non-linear burn-off behavior is achieved by virtue of the cellular structure of the stock comprising microcapsules which are filled with arc-extinguishing agents and which are destroyed by an erosion mechanism caused by the arc and in the process activate encapsulated material serving the formation of arc-extinguishing gas. Since, in the process, the ablation of the individual capsules takes place layer by layer from the outside inwards, the erosion mechanism comes to a standstill when the arc power drops below the threshold value.

The erosion mechanism can be elicited primarily by the following arc actions:

(a) The material provided in the cells of the stock absorbs—for example—via embedded colorant pigments—arc radiation. The material, generally in the form of a liquid, evaporates or decomposes and increases the pressure in the irradiated cells. Above a threshold value defined by the intensity of the radiation, the cell walls are destroyed, owing to the elevated pressure and elevated temperature, and the material is liberated in the form of arc-extinguishing gas.

(b) Radiation absorption predominantly takes place in the cell walls, which, for example, contain colorant pigments. Absorption primarily increases the temperature of the cell walls which causes these to soften and to open.

(c) Reactive particles liberated in the arc zone are conveyed, by means of arc-heated gas, to the stock giving off arc-extinguishing gas and, via a chemical reaction with the cell walls, cause the opening of the cells and the liberation of the material which forms arc-extinguishing gas.

(d) The thermal shock effect of the hot gas which formed explosively during formation of the arc embrittles the cell walls and liberates the material which forms arc-extinguishing gas.

(e) An arc fed by a strong current is generally accompanied by a pressure wave whose onset is explosive and which destroys the cell walls and which suddenly releases the material which forms arc-extinguishing gas.

The erosion mechanisms listed under (a) and (b) require the stock giving off arc-extinguishing gas to be positioned in the direct radiation field of the arc. If the stock is used in a gas-blast circuit breaker comprising an insulating-material nozzle and having a heating volume which serves for the storage of arc-heated compressed gas and which is connected to the arc-extinguishing zone via a heating duct, this preferentially relates to the heating duct and the nozzle diffuser.

The erosion mechanisms listed under (c)–(e) can also occur in stock which gives off arc-extinguishing gas and which is located outside the direct radiation field (field of vision) of the arc. If the stock is employed in a gas-blast circuit breaker comprising an insulating nozzle and having a heating volume, the stock can then serve for lining the heating volume situated outside the field of vision of the arc. A hot-gas stream, which is generated, in the event of a switching operation, in the arc-extinguishing zone by arc heating and is passed into the heating volume, then liberates fresh arc-extinguishing gas by opening the cells, as a result of which a large amount of high-quality arc-extinguishing gas is available for arc extinction.

A suitable material for the cells to be charged with has arc-extinguishing properties or, when exposed to an arc, forms arc-extinguishing gas. Preferred as a material are liquid or gaseous fluorine compounds on the basis of nitrogen, oxygen, hydrogen, carbon and/or sulfur with as high a density and as low a carbon percentage as possible. Particular preference is given, owing to their large fluorine percentage, to perfluorinated liquids. Advantageously, the liquid fluorine compounds have a boiling point above 100° C. As an alternative to fluorine compounds, it is possible to use explosives and explosive substances such as $NH_4NO_3$, which have been desensitized in a suitable matrix insulating material such as PTFE.

For manufacture-related reasons, the filler may be made from a powder whose particles, prior to being embedded in the insulating-material matrix, are predominantly in the form of microcapsules having particle sizes up to 1 mm. The insulating-material matrix serving to hold the microcapsules is preferably made from a molding composition, in particular on the basis of an epoxy resin, a polyester resin, an acrylic resin or a polyurethane resin, being cured. Instead of by embedding the powder which predominantly contains microcapsules in the matrix, the stock may also be formed by sintering or bonding the powder particles together.

The cell walls of the microcapsules whose size is typically from 5 to 100 $\mu$m are predominantly made from a polymer, a ceramic or glass. Particularly suitable materials are polymers on the basis of a melamine-formaldehyde resin, an acrylic resin or a polyurethane resin.

The insulating-material matrix may be admixed, for the purpose of improving the density, with additional fillers, for example graphite powder. By adding colorants having long-term stability (service life >20 years) into the insulating-material matrix and/or into the filler, it is possible to regulate the burn-off behavior of the stock. Good utility as a colorant is ensured by a fraction of from 0.01 to 1 percent by weight of $MOS_2$ in the stock.

In a gas-blast circuit breaker the arc-extinguishing gas escaping from the cells serves for stabilizing the density of the arc-extinguishing gas, heated by a switching arc, in the phase before and after current zero beyond a dielectrically critical value and for the partial compensation for the amounts of arc-extinguishing gas flowing away. As a result, an essentially unchanged size of the chute is accompanied by a higher breaking capacity.

A precondition for this is that the stock serves, at least in part, for guiding the arc-extinguishing gas flow and is positioned at such points of the extinguishing gas guiding arrangement, at which the stock is exposed to the radiation of the arc and the thermal action of arc gases. Particularly advantageously, the stock serves for the lining of flow-guiding parts which are situated upstream and/or downstream of the constriction of an insulating-material nozzle of the switch. Additional advantage is provided by the stock also being disposed outside the arc-extinguishing zone proper of the circuit breaker and to employ it as a lining of a volume, situated upstream of the nozzle constriction, for storing arc-heated extinguishing gas.

BRIEF DESCRIPTION OF THE DRAWINGS

A more complete appreciation of the invention and many of the attendant advantages thereof will be readily obtained as the same becomes better understood by reference to the followed detailed description of a preferred embodiment of the invention when considered in connection with the accompanying drawings, wherein.

DESCRIPTION OF THE PREFERRED EMBODIMENTS

Figure 1:
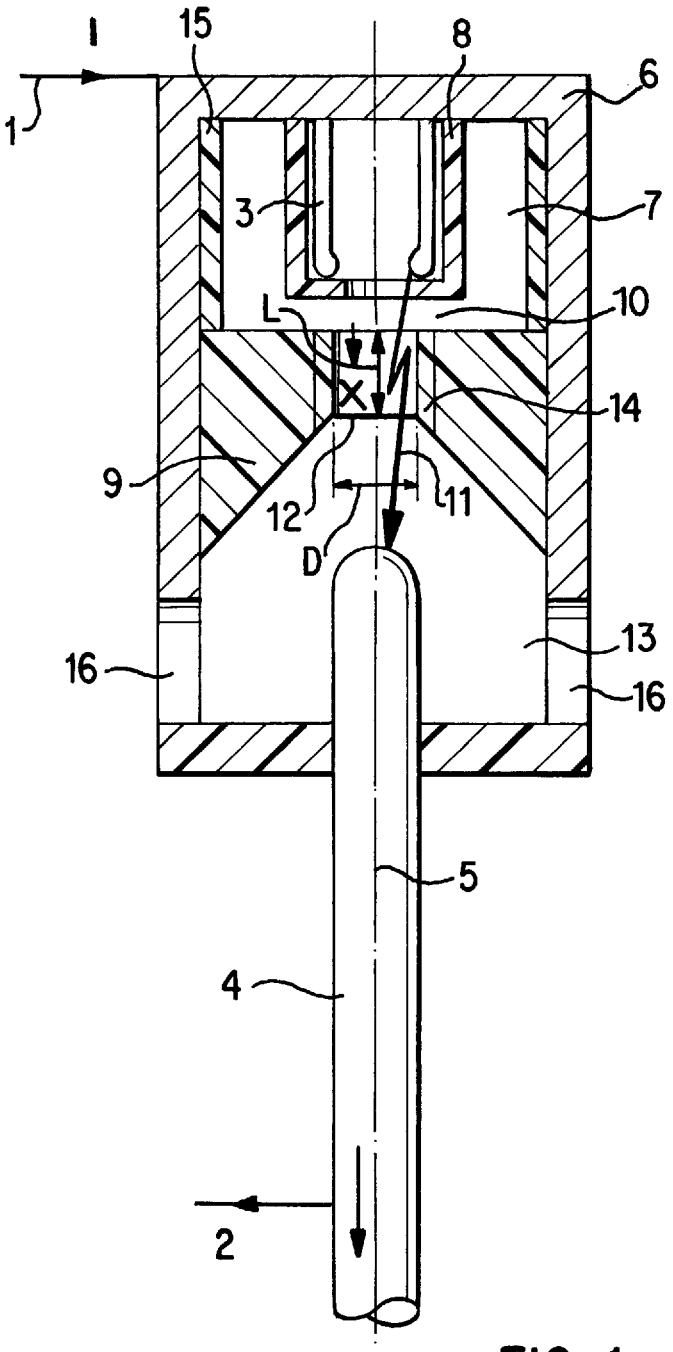
FIG. 1 shows an arc chute of a gas-blast circuit breaker comprising a replaceable insulating nozzle made of stock of the invention and giving off an arc-extinguishing gas, of PTFE or of another stock from the prior art, whose nozzle interior is connected, via a heating duct, to a heating volume for holding an arc-extinguishing gas.

Referring now to the drawings, wherein like reference numerals designate identical or corresponding parts throughout the several views, the arc chute shown in FIG. 1 is situated in a housing (not shown), filled with an insulating and arc-extinguishing gas such as, for example, $SF_6$ at a pressure of, for example, from 4 to 6 bar, of a medium-voltage circuit breaker for nominal voltages of typically from 10 to 40 kV. The arc chute comprises two contact pieces 3 and 4, each connected, via a current terminal 1 and 2, respectively, to a power source. The contact piece 3 is arranged so as to be fixed and is contacted, in the make state (not shown) by the contact piece 4 which can be displaced along an axis 5. The wall 6 of the arc chute encloses a heating volume 7, of toroidal shape, which is delimited, on its inner face, by an insulator 8 of essentially hollow cylindrical shape, and downward by an exposed end face of an insulating nozzle 9. The exposed end faces of insulator 8 and insulating nozzle 9 delimit an annular duct 10. During a break operation shown in FIG. 1, the duct 10 connects the arc-extinguishing zone which upon breaking accommodates a switching arc 11 burning between the contact pieces 3, 4, with the heating volume 7. The insulating nozzle 9 has an axially aligned cylindrical hole. The cylindrical hole forms a tubular constriction 12 having a length L and a diameter D and expands, downstream of the constriction 12, to form a diffuser leading into an expansion chamber 13 having two outlets 16.

The insulating nozzle 9, but at least a nozzle section 14 exposed to the action of the switching arc and, if required, the insulator 8—at least in the region of its end face delimiting the duct 10—and portions of a lining 15 of the heating volume 7 are formed by a stock 17 giving off arc-extinguishing gas and having a cellular structure, a predominant portion of the cells or microcapsules 18 being filled with a material 19 which has arc-extinguishing properties or containing a material which, upon exposure to an arc, forms the arc-extinguishing gas.

Such a stock 17 can be produced, for example as follows: starting components for producing the stock are:

(a) a perfluorinated alkane having a boiling point of approximately 215° C., for example a liquid from 3M, Minnesota Mining, which is sold under the trade name Fluorinert FC 5312, (b) a melamine-formaldehyde resin (MF), (c) a resin, for example an epoxy resin sold by Ciba-Geigy under the trade name Araldit CY 225, (d) a curing agent as sold by Ciba-Geigy under the designation Harter HY 925, and (e) if required a colorant, for example powdered molybdenum disulfide.

Starting from the components (a) and (b), and by means of suitable mixing and spray-drying processes, a dry and free-flowing powder containing microcapsules 18 is prepared. The microcapsules have grain sizes of from 6 to 10 $\mu$m and each comprise an MF envelope which carries the perfluorinated liquid. The proportions of the two starting components are defined in such a way that the microcapsules contain approximately 80 to 90 percent by weight of liquid and approximately 10 to 20 percent by weight of MF.

100 parts by weight of the component (c), 80 parts by weight of the component (d) and a filler comprising 180 parts by weight of this powder were mixed together. The resulting mixture was evacuated and, in vacuo, poured into a mold in which it gelled for 4 h at approximately 80° C. and was cured over approximately 16 h at 140° C. to give the stock or a virtually ready-to-use component, for example an insulating-material nozzle.

An insulating nozzle 9 thus produced was installed in the arc chute, according to FIG. 1, and the gas-blast circuit breaker was repeatedly disconnected, short-circuit current being approximately 25 kA. Corresponding operations were carried out with the same arc chute in which, however, instead of the insulating nozzle 9 made of microcapsule stock 17, nozzles having the same geometric dimensions made of PTFE and microcapsule-free epoxide were used.

Upon disconnection the cell walls 20 of the microcapsules 18 burst under the influence of the switching arc 11 burning through the constriction 12 of the insulating-material nozzle 9. Perfluorinated liquid is sprayed from the open capsules and promotes arc extinction quite significantly, owing to its cooling effect, owing to the formation of fresh arc-extinguishing gas under high pressure, and owing to the electronegative action of fluorocarbons during the thermal decomposition in the switching arc. In the process, the arc-extinguishing gas formed, together with the arc-extinguishing gas stored in the arc chute, is first, in the high-current phase and accompanied by pressure build-up, stored in the heating volume 7 and then, during current zero, is used for blowing onto the switching arc 11.

Since the insulating material formed from the components (c) and (d) is transparent, the radiation of the switching arc is able to penetrate, depending on conditions, several millimeters into the insulating-material nozzle 9. Via an addition of approximately 0.01 to 1 percent by weight of component (e) during mixing of the starting components, the penetration depth of the arc radiation and thereby also the burn-off depth of the insulating-material nozzle 9 during a switching operation was reduced to a few tenths of a millimeter.

Figure 2:
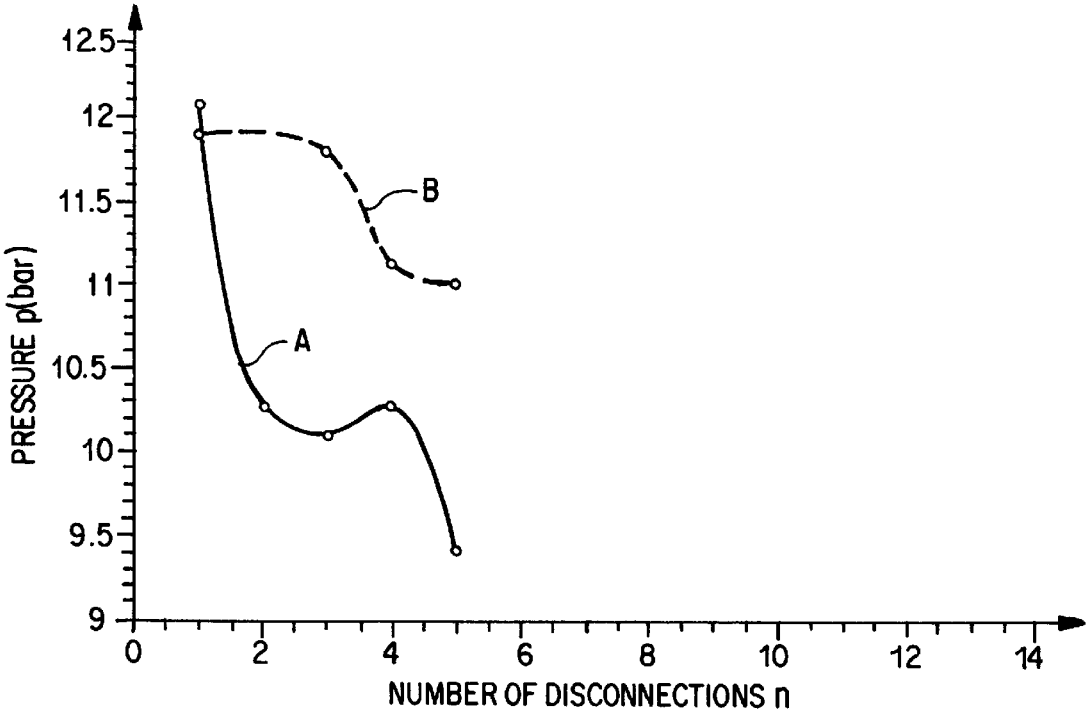
FIG. 2 shows a diagram in which the pressure build-up p [bar] in the heating volume of the gas-blast circuit breaker according to FIG. 1 is shown as a function of the number n of disconnections.

The following FIG. 2 then depicts the pressure build-up in the heating volume 7 of the gas-blast circuit breaker comprising an insulating-material nozzle 9 made of the microcapsule stock (B) as a function of the number of disconnections. At the same time, corresponding comparative data for a gas-blast circuit breaker comprising an insulating nozzle made of an $Al_2O_3$-filled epoxide (A) from the prior art are shown. This shows that, after a number of disconnections, the circuit breaker comprising the insulating-material nozzle 9 made of microcapsule stock 17 is distinguished by considerably better pressure build-up.

Figure 3:
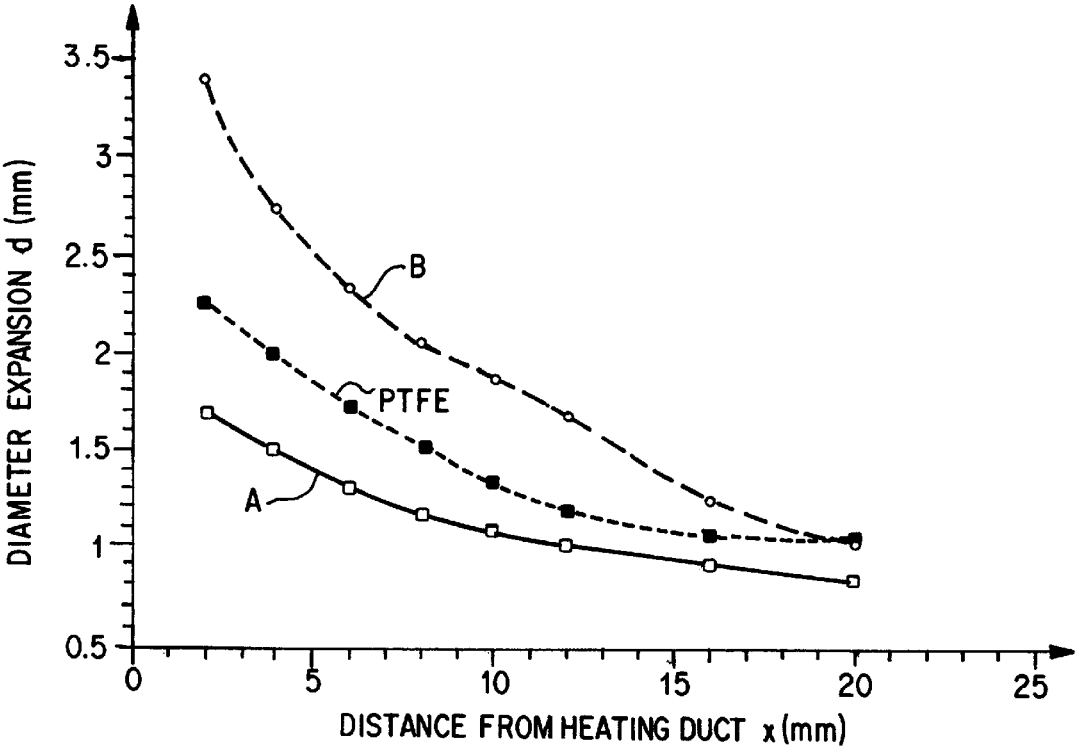
FIG. 3 shows a diagram in which the burn-off of the insulating-material nozzle of the gas-blast circuit breaker according to FIG. 1, measured as a diameter expansion d [mm] of its constriction which in the initial stage is of tubular shape, is shown as a function of the distance x [mm] of the measuring point from that end of the nozzle which is open toward the heating duct.
Figure 4:
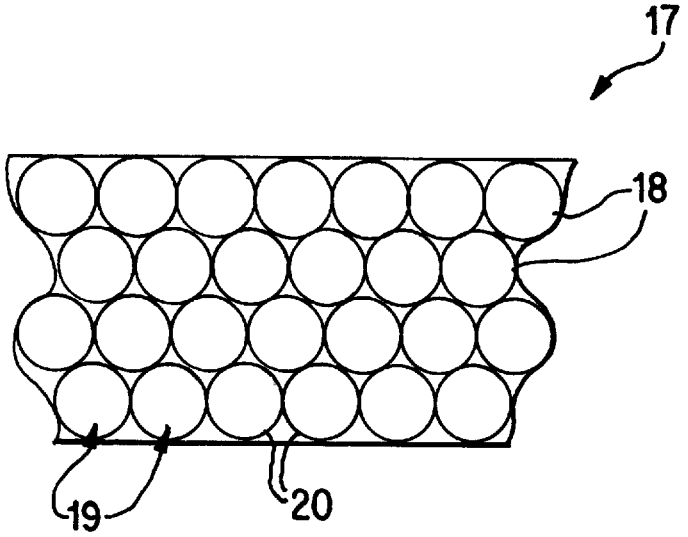
FIG. 4 shows a cellular structure formed from microcapsules which are embedded in a polymer matrix.

In FIG. 3, burn-off after a number of disconnections n and measured as a diameter expansion d is plotted as a function of the distance x of the measuring point from that end of the constriction 12 which is open toward the heating duct. Evidently, the nozzle in the case of the gas-blast circuit breaker comprising the microcapsule stock burns relatively strongly at the end (x=0) situated in the region of the duct 10, owing to the vigorous formation of arc-extinguishing gas. Since, however, that end of the constriction 12 which faces a diffuser (x=20=L) has burnt to a relatively limited extent, the nozzle, compared to a nozzle from the prior art and in terms of the constriction dimension relevant for the making and breaking capacity of the gas-blast circuit breaker, has virtually the same burn-off behavior in conjunction with a considerably improved pressure build-up. If said flow-determining constriction of the nozzle is made from a material having particularly low burn-off, such as, for example, boron nitride or silicon nitride or zirconium oxide, particularly low burn-off behavior is achieved in conjunction with, at the same time, particularly good pressure build-up in the heating volume 7.

Obviously, numerous modifications and variations of the present invention are possible in light of the above teachings. It is therefore to be understood that, within the scope of the appended claims, the invention may be practised otherwise than as specifically described herein.

What is claimed as new and desired to be secured by Letters Patent of the United States of is:

1. An electrically insulating stock which gives off arc-extinguishing gas when exposed to an arc, said stock comprising an insulating-material matrix and a filler embedded in the matrix, said filler comprises a cellular structure in which a predominant portion of the cells is filled with a material having arc-extinguishing properties or contains a material which upon exposure to an arc forms the arc-extinguishing gas.

2. The stock as claimed in claim 1, wherein the cell walls are formed by membranes which upon exposure to the arc can be selectively destroyed above a threshold value of the arc exposure.

3. The stock as claimed in claim 2, wherein the cells, starting from a surface which can be exposed to an arc, are disposed at different distances from the surface.

4. The material as claimed in claim 3, wherein the cells are arranged in the form of layers.

5. The stock as claimed in claim 1, wherein the filler is formed by a powder whose particles, prior to being embedded in the insulating-material matrix, predominantly take the form of microcapsules having particle sizes of up to 1 mm.

6. The stock as claimed in claim 5, wherein the microcapsules, after being embedded, are held in a cured molding composition which forms the insulating-material matrix and which is based on an epoxy resin, a polyester resin, acrylic resin or a polyurethane resin.

7. The stock as claimed in claim 1, wherein the stock is formed by sintering or bonding together a powder whose particles, prior to sintering or bonding, are in the form of microcapsules having particle sizes of up to 1 mm.

8. The stock as claimed in claim 5, wherein the microcapsules comprise a cell wall made of a polymer, a ceramic or glass and a filling with material comprising a fluorinated liquid, especially having a boiling point above 100° C.

9. The stock as claimed in claim 8, wherein the microcapsules have particle sizes of typically from 5 to 100 $\mu$m and have capsule walls made from a melamine-formaldehyde resin, an acrylic resin or a polyurethane resin.

10. The stock as claimed in claim 1, wherein the filler is an explosive substance or explosive forming arc-extinguishing gas.

11. The stock as claimed in claim 10, wherein the explosive substance or explosive is embedded in an insulating-material matrix, said matrix having a desensitizing effect.

12. The stock as claimed in claim 11, wherein the insulating-material matrix is admixed with graphite powder.

13. The stock as claimed in claim 1, wherein the insulating-material matrix and/or the filler contains a colorant having long-term stability.

14. The stock as claimed in claim 13, wherein the insulating-material matrix contains approximately from 0.01 to 1 percent by weight of $MOS_2$.

15. A gas-blast circuit breaker comprising the stock as claimed in claim 1, a switching arc formed during a switching operation, wherein said switching arc is exposed to an arc-extinguishing gas flow, wherein the stock serves, at least in part, for guiding the arc-extinguishing gas flow and is situated on such points of the arc-extinguishing gas guiding system, at which the stock is exposed to the radiation of the arc and the thermal action of arc gases.

16. The gas-blast circuit breaker as claimed in claim 15, further comprising an insulating-material nozzle having a nozzle constriction, wherein at least flow-guiding parts of the nozzle, which are situated upstream of the nozzle constriction, are lined with the stock.

17. The gas-blast circuit breaker as claimed in claim 16, farther comprising a heating volume which is situated upstream of the nozzle constriction and serves for storing arc-heated arc-extinguishing gas, wherein the heating volume is lined, at least in part, with the stock.

* * * * *